US008384028B2

(12) United States Patent
Fujita et al.

(10) Patent No.: US 8,384,028 B2
(45) Date of Patent: Feb. 26, 2013

(54) MS/MS MASS SPECTROMETER

(75) Inventors: Shinjiro Fujita, Kyoto (JP); Daisuke Okumura, Kyoto (JP); Hiroto Itoi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 292 days.

(21) Appl. No.: 12/865,251

(22) PCT Filed: May 13, 2008

(86) PCT No.: PCT/JP2008/001197

§ 371 (c)(1),
(2), (4) Date: Jul. 29, 2010

(87) PCT Pub. No.: WO2009/095958

PCT Pub. Date: Aug. 6, 2009

(65) Prior Publication Data

US 2011/0006203 A1 Jan. 13, 2011

(30) Foreign Application Priority Data

Jan. 30, 2008 (WO) ..... PCT/JP2008/000111

(51) Int. Cl.
*H01J 49/06* (2006.01)

(52) U.S. Cl. ..... 250/293; 250/281; 250/282; 250/286; 250/288; 250/290

(58) Field of Classification Search ..... 250/281, 250/282, 286, 288, 289, 290, 293
See application file for complete search history.

(56) References Cited

U.S. PATENT DOCUMENTS

| | | | | |
|---|---|---|---|---|
| 6,504,148 | B1 * | 1/2003 | Hager | 250/282 |
| 6,683,301 | B2 * | 1/2004 | Whitehouse et al. | 250/288 |
| 6,967,323 | B2 * | 11/2005 | Hashimoto et al. | 250/281 |
| 7,049,584 | B1 * | 5/2006 | Whitehouse et al. | 250/288 |
| 7,064,319 | B2 * | 6/2006 | Hashimoto et al. | 250/287 |
| 2002/0030159 | A1 * | 3/2002 | Chernushevich et al. | 250/287 |
| 2003/0122071 | A1 * | 7/2003 | Plomley et al. | 250/292 |
| 2007/0187585 | A1 * | 8/2007 | Verentchikov | 250/287 |
| 2009/0127453 | A1 * | 5/2009 | Ding et al. | 250/282 |

FOREIGN PATENT DOCUMENTS

| | | | |
|---|---|---|---|
| CA | 1249381 | | 1/1989 |
| EP | 0 237 259 | A2 | 9/1987 |
| JP | 62-264546 | A | 11/1987 |
| JP | 07-201304 | A | 8/1995 |
| JP | 07201304 | A * | 8/1995 |
| JP | 10-055777 | A | 2/1998 |
| JP | 2005-183328 | A | 7/2005 |
| WO | 2005-124821 | A1 | 5/2005 |

* cited by examiner

*Primary Examiner* — Michael Logie
(74) *Attorney, Agent, or Firm* — Sughrue Mion, PLLC

(57) ABSTRACT

During a halt period of time when the introduction of ions is temporarily discontinued to change an objective ion to be selected by a first mass separator in the previous stage, a pulsed voltage having a polarity opposite to that of the ions remaining in a collision cell (4) is applied to an entrance lens electrode (42) and exit lens electrode (44). The ions are pulled by the DC electric field created by this voltage, to be neutralized and removed by colliding with the lens electrodes (42, 44). Thus, the residual ions, which may cause a crosstalk, can be quickly removed from the inner space of the collision cell (4) without contaminating an ion guide (5) to which a radio-frequency is applied. Since no radio-frequency voltage is applied to the lens electrodes (42, 44), the circuit for applying the pulsed voltage can have a simple configuration. Thus, the cost increase is suppressed.

14 Claims, 5 Drawing Sheets

MS/MS MASS SPECTROMETER

TECHNICAL FIELD

The present invention relates to an MS/MS mass spectrometer for performing a mass analysis of product ions (fragment ions) generated by dissociating an ion having a specific mass (or mass-to-charge ratio, to be exact) by collision-induced dissociation (CID).

BACKGROUND ART

An MS/MS mass analysis (or tandem analysis) is known as one of the mass spectrometric methods for identifying a substance with a large molecular weight and for analyzing its structure. A triple quadrupole (TQ) mass spectrometer is a typical MS/MS mass spectrometer. FIG. 11 is a schematic configuration diagram of a generally used triple quadrupole mass spectrometer disclosed in Patent Document 1 or other documents.

This mass spectrometer has an analysis chamber 1 evacuated by a vacuum pump (not shown). This chamber contains an ion source 2 for ionizing a sample to be analyzed, three quadrupoles 3, 5 and 6, each including four rod electrodes, and a detector 7 for detecting ions and producing detection signals corresponding to the amount of detected ions. A voltage composed of a DC voltage and a radio-frequency (RF) voltage is applied to the first-stage quadrupole 3. Due to the effect of the electric field generated by this composite voltage, only an objective ion having a specific mass is selected as a precursor ion from various kinds of ions produced by the ion source 2.

The second-stage quadrupole 5 is contained in a highly airtight collision cell 4. A CID gas, such as argon (Ar) gas, is introduced into this collision cell 4. After being transferred from the first-stage quadrupole 3 to the second-stage quadrupole 5, the precursor ion collides with the CID gas within the collision cell 4, to be dissociated into product ions by a CID process. Since this dissociation can occur in various forms, one kind of precursor ion normally produces plural kinds of product ions with different masses. Then, these plural kinds of product ions are extracted from the collision cell 4 and introduced into the third-stage quadrupole 6. The second-stage quadrupole 5 is normally applied with either a pure radio-frequency voltage or a voltage generated by adding a DC bias voltage to the radio-frequency voltage. Due to this voltage application, the second-stage quadrupole 5 functions as an ion guide for transporting ions to the subsequent stages while converging these ions.

Similar to the first-stage quadrupole 3, the third-stage quadrupole 6 is applied with a voltage composed of a DC voltage and a radio-frequency voltage. Due to the effect of the electric field generated by this voltage, only a product ion having a specific mass is selected in the third-stage quadrupole 6, and the selected ion reaches the detector 7. By appropriately changing the DC voltage and the radio-frequency voltage, it is possible to change the mass of the ion that is allowed to pass through the third-stage quadrupole 6. Based on the detection signals produced by the detector 7 during this operation, a data processor (not shown) creates a mass spectrum of the product ions resulting from the dissociation of the objective ion.

Since, in the mass spectrometer having the previously described configuration, the CID gas is supplied into the collision cell 4, the gas pressure within the collision cell 4 is generally at a few to several mTorr, which is higher than the gas pressure outside the collision cell 4. When an ion travels through a radio-frequency electric field under an atmosphere of such a relatively high gas pressure, the ion gradually loses its kinetic energy due to the collision with the gas, and its flight speed decreases accordingly.

For example, in the case of using an MS/MS mass spectrometer as a detector of a liquid chromatograph, the operation of measuring the signal intensity while sequentially changing the mass of the precursor ion is repeated. In this case, if the flight speed of the ions within the collision cell 4 decreases as just described, it is possible that, when the precursor ion (objective ion) is changed from one ion having a certain mass to another ion having a different mass, the next precursor ion begins to be introduced into the collision cell 4 while the previous precursor ion and the product ions originating from this precursor ion still remain in the collision cell 4, causing these ions to be mixed. This phenomenon is called a "crosstalk" in the MS/MS analysis. The crosstalk may deteriorate the quality of the quantitative measurement of the objective component.

The apparatus described in Patent Document 2 has a linear ion trap with a quadrupole configuration in which a pulsed voltage is applied instead of the ion-capturing radio-frequency voltage to remove ions remaining in the space surrounded by the quadrupole. Due to the effect of the electric field created by the pulsed voltage, the ions are pulled toward the quadrupole and touch the quadrupole to become neutral molecules. However, the radio-frequency voltage applied to the quadrupole is normally as high as a kV-order amplitude; applying a pulsed voltage instead of this high radio-frequency voltage requires a power supply circuit with a rather complex configuration. In fact, the apparatus described in Patent Document 2 uses an elaborate power supply circuit.

Patent Document 1: Japanese Unexamined Patent Application Publication No. H7-201304

Patent Document 2: Pamphlet of International Publication No. 2005/124821

DISCLOSURE OF THE INVENTION

Problem to be Solved by the Invention

Thus, the attempt to remove ions remaining in the collision cell by the aforementioned conventional techniques inevitably causes a significant increase in cost since it requires a considerably complex power supply circuit. Furthermore, if the ions remaining in the collision cell are removed by the aforementioned conventional techniques, the ion guide provided in the collision cell is contaminated due to the adhesion of the removed ions. To clean the ion guide, it is necessary to perform cumbersome, time-consuming operations, such as detaching the ion guide from the collision cell, dismantling it, cleaning and reassembling it.

The present invention has been developed to solve the previously described problems. One of its objectives is to provide an MS/MS mass spectrometer having a power supply circuit and control circuit with a simple hardware configuration and simple control program, but yet capable of quickly removing unnecessary residual ions within the collision cell (specifically, the precursor ion used in the previous measurement and other ions originating from this precursor ion) when changing the measurement target from one precursor ion to another.

Another objective of the present invention is to provide an MS/MS mass spectrometer in which the contamination of the ion guide contained in the collision cell is decreased to the lowest possible level in the process of removing unnecessary residual ions in the collision cell, thus reducing the time and labor for cleaning those parts.

Means for Solving the Problems

The present invention aimed at solving the aforementioned problems is an MS/MS mass spectrometer including: a first mass separator for selecting, as a precursor ion, an ion having a specific mass from among various kinds of ions; a collision cell, containing an ion guide for transporting ions by a radio-frequency electric field while converging those ions, for making the precursor ion collide with a predetermined gas to dissociate the precursor ion by collision-induced dissociation; and a second mass separator for selecting an ion having a specific mass from among various kinds of product ions generated by the dissociation of the precursor ion, the first mass separator, the collision cell and the second mass separator being linearly arranged, and the MS/MS mass spectrometer is characterized by including:

a) lens electrodes respectively provided at the entrance end and the exit end of the collision cell;
b) a voltage-applying means for applying a DC voltage to one or both of the entrance lens electrode and the exit lens electrode; and
c) a control means for controlling the voltage-applying means so that a pulsed DC voltage for either pulling or repelling the ions in the collision cell is applied to the aforementioned one or both of the lens electrodes at a predetermined timing.

In the MS/MS mass spectrometer according to the present invention, for example, when the ejection of ions into the first mass separator is temporarily halted to change the target ion to be selected, the control means operates the voltage-applying means so that a pulsed DC voltage having a polarity opposite to that of the ions remaining in the collision cell is applied to the exit lens electrode. Due to the electric field created by this voltage, the residual ions in the collision cell are accelerated toward the exit lens electrode. These ions eventually collide with the exit lens electrode, to be neutralized by giving or receiving electrons. In this manner, the unnecessary residual ions in the collision cell are quickly removed.

Therefore, when the next target ion is selected as a precursor ion in the first mass separator and this precursor ion is sent into the collision cell, the previous precursor ion and the product ions originating from this precursor ion no longer remain in the collision cell. Thus, the crosstalk in the MS/MS analysis is avoided.

It is a normal practice to apply a DC bias voltage to the lens electrodes provided at the entrance and exit ends of the collision cell. By contrast, it is quite rare that a radio-frequency voltage, particularly a radio-frequency voltage with large amplitude, is applied to those lens electrodes. Therefore, the previously described function of removing ions within the collision cell can be realized without complicating the hardware configuration and control program of the power supply circuit and control circuit for applying the pulsed DC voltage. Thus, the cost increase is suppressed.

In the MS/MS mass spectrometer according to the present invention, when the ions within the collision cell are pulled or repelled so that they touch the lens electrodes, the ion guide in the collision cell is prevented from being contaminated with neutralized molecules. Although the neutralized molecules adhere to either one or both of the entrance and exit lens electrodes, these members can be more easily cleaned within a short period of time as compared to the ion guide, which is contained within the collision cell. As a result, the time and labor for the cleaning work is reduced.

When viewed as a whole, the ions remaining in the collision cell are moving in the direction from the entrance lens electrode to the exit lens electrode due to the kinetic energy that they have when introduced into the collision cell. Accordingly, in the MS/MS mass spectrometer according to the present invention, it is preferable that the voltage-applying means apply, to the exit lens electrode, a DC voltage with a polarity opposite to that of the ions within the collision cell. By this operation, the ions are accelerated in such a manner that their progression that has been ongoing from before the application of the pulsed DC voltage is further promoted, so that the ions will be more efficiently removed.

As one mode of the MS/MS mass spectrometer according to the present invention, the voltage-applying means may apply, to both the entrance lens electrode and the exit lens electrode, a DC voltage with a polarity opposite to that of the ions within the collision cell.

By this configuration, the ions remaining in the collision cell are removed by being pulled to both the entrance lens electrode and the exit lens electrode. Therefore, the residual ions within the collision cell can be removed in a shorter period of time than in the case where the pulsed DC voltage with a polarity opposite to that of the ions is applied to only one of the entrance and exit lens electrodes.

As another mode of the MS/MS mass spectrometer according to the present invention, the voltage-applying means may apply DC voltages with opposite polarities to the entrance lens electrode and the exit lens electrode, respectively.

By this configuration, the ions remaining in the collision cell are accelerated toward one lens electrode to which the DC voltage with a polarity opposite to that of the ions is applied and also accelerated away from the other lens electrode to which the DC voltage with the same polarity as that of the ions is applied. Since both accelerating directions are the same, the residual ions within the collision cell can be removed in a shorter period of time than in the case where a pulsed DC voltage with a polarity opposite to that of the ions is applied to only one of the entrance and exit lens electrodes. Another advantage is that the output capacity of the power supply circuit can be reduced since a DC electric field having a large potential gradient can be created in the collision cell even if the value (absolute value) of the pulsed DC voltage is relatively small.

As explained previously, the ions in the collision cell are generally moving in the direction from the entrance to the exit. Therefore, in the previously described mode of the present invention, it is preferable that the DC voltage applied to the exit lens electrode has a polarity opposite to that of the ions within the collision cell. This also means that the DC voltage applied to the entrance voltage electrode has the same polarity as that of the ions within the collision cell. By this configuration, the ions are accelerated in such a manner that the movement of ions imparted before the application of the pulsed DC voltage is promoted, so that the ions will be more efficiently removed.

In the MS/MS mass spectrometer according to the present invention, it is possible to construct so that the voltage-applying means applies a DC voltage having the same polarity as that of the ions within the collision cell to one or both of the entrance lens electrode and the exit lens electrode, and the control means operates the voltage-applying means to discontinue the application of the radio-frequency voltage to the ion guide at a timing of applying the pulsed DC voltage to one or both of the entrance lens electrode and the exit lens electrode.

After the application of the radio-frequency voltage to the ion guide is discontinued, the ions are no longer bound by the radio-frequency electric field. Therefore, rather than being converged around the ion optical axis, they will tend to spread within the collision cell. In this situation, when a pulsed voltage having the same polarity as that of the ions is applied to one or both of the lens electrodes, the ions will be repelled from the lens electrodes due to the resultant DC electric field, moving closer to the ion guide, whose electric potential is relatively low (i.e. the absolute value is small). They will eventually touch the ion guide and be neutralized.

In this configuration, the ions do not come in contact with the lens electrodes but the ion guide. Therefore, the ion guide will be contaminated and it will be necessary to take time to clean it. However, since the distance between the ions remaining in the collision cell and the ion guide is, on the average, much shorter than the distance between the ions and the lens electrodes, the ions can touch the ion guide within shorter periods of time. As a result, the residual ions within the collision cell will be quickly and efficiently removed, so that the crosstalk will be more assuredly prevented.

In the MS/MS mass spectrometer according to the present invention, it is preferable that the "predetermined timing" for applying the pulsed DC voltage be set within a halt period when the ejection of ions into the first mass separator is temporarily halted to change the target ion to be selected. More preferably, the timing should be set at a point in time immediately before the end of the halt period.

The timing "immediately before the end" is a point in time closer to the end of the halt period rather than to the beginning of the halt period. It can be experimentally determined.

Even if no pulsed DC voltage is applied to the lens electrodes, most of the ions remaining in the collision cell are discharged from the collision cell through an exit aperture during the halt period. That is, the number of residual ions gradually decreases during the halt period. Therefore, it is possible to decrease the amount of molecules neutralized by touching the lens electrodes or the ion guide by applying the pulsed DC voltage to the lens electrodes immediately before the end of the halt period. This operation lessens the degree of contamination of the lens electrodes and the ion guide, so that the frequency of the cleaning work can be lowered.

EFFECT OF THE INVENTION

By the MS/MS mass spectrometer according to the present invention, the ions remaining in the collision cell (i.e. the previous precursor ion and the product ions generated from this precursor ion) can be quickly removed from the collision cell at an appropriate timing, e.g. when the precursor ion is changed. As a result, the noise that appears in the MS/MS spectrum will be reduced, so that the accuracy of the quantitative and qualitative analyses will be improved. Particularly, the MS/MS mass spectrometer according to the present invention can achieve a high level of ion-removing effect at low cost. This is due to the use of a pulsed DC voltage applied to the lens electrodes to which no radio-frequency voltage with large amplitude is applied. The DC voltage creates a DC electric field having an ion-removing capability. The pulsed voltage can be applied without using a complex power supply circuit.

In the case where the residual ions within the collision cell are removed by being pulled toward the lens electrodes, the neutralized molecules adhere to one or both of the entrance and exit lens electrodes, while the adhesion of ions to the ion guide provided in the collision cell is avoided. Normally, it is only a DC bias voltage that is applied to the lens electrodes during the analysis, and the surface contamination of these lens electrodes has merely minor impacts on the analysis. Thus, it can be said that the present system is highly resistant to contamination. The lens electrodes can be more easily cleaned than the ion guide, which is contained within the collision cell. When a lens electrode is contaminated and needs to be cleaned, the cleaning work can be quickly completed with little effort.

EXPLANATION OF NUMERALS

1 . . . Analysis Chamber
2 . . . Ion Source
3 . . . First-Stage Quadrupole
4 . . . Collision Cell
41 . . . Cylindrical Body
42, 48 . . . Entrance Lens Electrode
43, 45, 47 . . . Aperture
44, 46 . . . Exit Lens Electrode
5 . . . Second-Stage quadrupole
6 . . . Third-Stage Quadrupole
7 . . . Detector
10 . . . Controller
11 . . . First Power Source
12 . . . Second Power Source
122 . . . Radio-Frequency Voltage Source
123 . . . DC Bias Voltage Source
124 . . . Adder
125 . . . Switching Unit
126 . . . Switch

13 . . . Third Power Source
20 . . . DC Power Source
21, 22, 23 . . . Pulsed Voltage Source

BEST MODE FOR CARRYING OUT THE INVENTION

First Embodiment

One embodiment (first embodiment) of the MS/MS mass spectrometer according to the present invention is hereinafter described with reference to the attached drawings.

Figure 1:
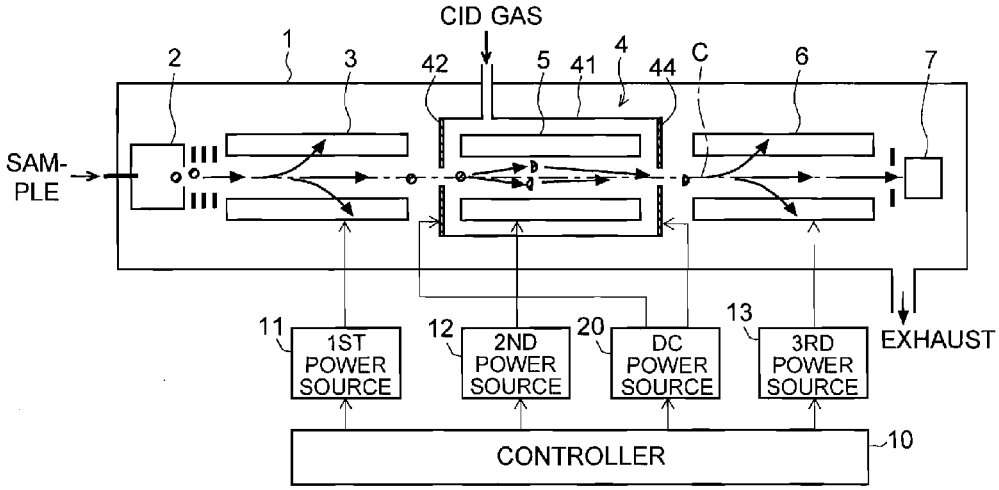
FIG. 1 is an overall configuration diagram of an MS/MS mass spectrometer according to one embodiment (first embodiment) of the present invention.
Figure 2:
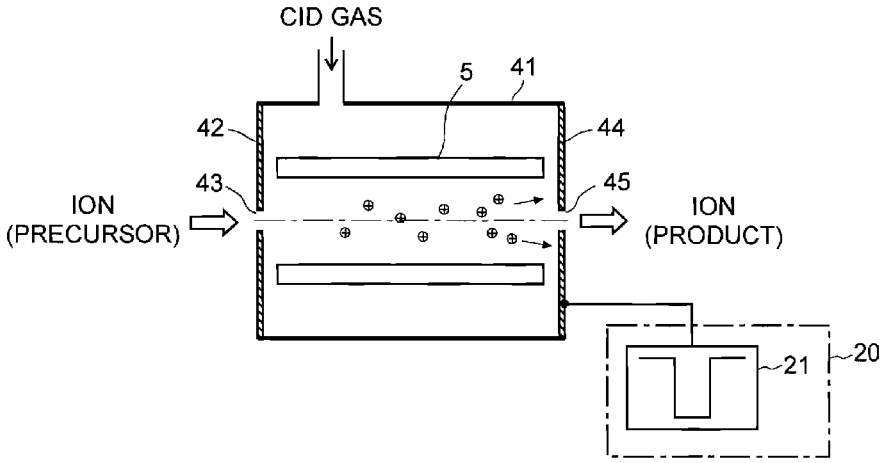
FIG. 2 is a configuration diagram of the collision cell and its power supply system in the MS/MS mass spectrometer of the first embodiment.

FIG. 1 is an overall configuration diagram of the MS/MS mass spectrometer of the first embodiment. FIG. 2 is a schematic configuration diagram of the collision cell 4 in FIG. 1 and its control-system circuit. The same components as used in the previously described conventional configuration are denoted by the same numerals and will not be specifically described.

Similar to the conventional case, the MS/MS mass spectrometer of the present embodiment has a first-stage quadrupole 3 (which corresponds to the first mass separator of the present invention) and a third-stage quadrupole 6 (which corresponds to the second mass separator of the present invention), between which a collision cell 4 for dissociating a precursor ion to produce various kinds of product ions is located, and a second-stage quadrupole 5 serving as the ion guide of the present invention is provided within this cell.

In the collision cell 4, the cylindrical body 41 enclosing the second-stage quadrupole 5 is made of an insulating member. The cylindrical body 41 has an entrance lens electrode 42 and an exit lens electrode 44 provided at the ion-injection end face and the ion-ejection end face, respectively, both electrodes consisting of a metal or other electrically conductive members. The entrance lens electrode 42 and the exit lens electrode 44 each consist of a substantially ring-shaped member with an ion-passing aperture 43 or 45 formed at or near its center.

A first power source 11 applies, to the first-stage quadrupole 3, either a composite voltage $\pm(U1+V1\cdot\cos\omega t)$ including a DC voltage U1 and a radio-frequency voltage $V1\cdot\cos\omega t$ or a voltage $\pm(U1+V1\cdot\cos\omega t)+Vbias1$ including the aforementioned composite voltage with a predetermined DC bias voltage Vbias1 added thereto. A second power source 12 applies, to the second-stage quadrupole 5, either a simple radio-frequency voltage $\pm V2\cdot\cos\omega t$ or a voltage $\pm V2\cdot\cos\omega t+Vbias2$ including the radio-frequency voltage with a predetermined DC bias voltage Vbias2 added thereto. A third power source 13 applies, to the third-stage quadrupole 6, either a composite voltage $\pm(U3+V3\cdot\cos\omega t)$ including a DC voltage U3 and a radio-frequency voltage $V3\cdot\cos\omega t$ or a voltage $\pm(U3+V3\cdot\cos\omega t)+Vbias3$ including the aforementioned composite voltage with a predetermined DC bias voltage Vbias3 added thereto. The first, second and third power sources 11, 12 and 13 operate under the control of a controller 10. These voltage settings are identical to those of the conventional case.

The entrance lens electrode 42 and the exit lens electrode 44 each have a predetermined voltage applied from a DC power source 20. The DC power source 20 has the function of a pulsed voltage source 21 for generating a pulsed voltage having a predetermined voltage level (pulse height) for a short period of time in response to an instruction from the controller 10. In addition to the pulsed voltage source 21, the DC power source 20 may also have the function of applying a predetermined DC bias voltage during a period of time when no pulsed voltage is applied. In the present example, on the assumption that the analysis target is a positive ion, a pulsed voltage having a negative polarity, which is opposite to that of the positive ion, is applied. It should be easy to understand that, when the analysis target is a negative ion, a pulsed voltage with a positive polarity, which is opposite to that of the negative ion, should be applied.

A characteristic operation of the MS/MS mass spectrometer of the present embodiment is hereinafter described. In the present MS/MS mass spectrometer, a plurality of objective ions having different masses are sequentially selected as a precursor ion in the first-stage quadrupole 3. The selected precursor ion is dissociated into product ions in the collision cell 4. These product ions are mass-separated in the third-stage quadrupole 6 and then detected by the detector 7.

At a certain point in time, an objective ion A is selected in the first-stage quadrupole 3 and sent into the collision cell 4, in which product ions are generated by collision-induced dissociation, and these product ions are mass-separated in the third-stage quadrupole 6. After the MS/MS analysis for the objective ion A is continued for a predetermined period of time, the objective ion to be selected in the first-stage quadrupole 3 is changed from the objective ion A to the next ion B having a different mass so as to perform an MS/MS analysis for this ion B. In this ion-changing operation, a halt period, in which no ion is introduced, is provided between the point where the previous objective ion A is for the last time introduced into the collision cell 4 and the point where the next objective ion B begins to be introduced into the collision cell 4. For example, this halt period is approximately 5 msec.

The controller 10 controls the pulsed voltage source 21 so as to apply a pulsed voltage to the exit lens electrode 44 during the halt period. During this period, although no new ion is introduced into the collision cell 4, the previously introduced objective ion A as well as various product ions A' resulting from the dissociation of this objective ion still remain within the collision cell 4. When a negative pulsed voltage is applied to the exit lens electrode 44, a DC electric field is created in the collision cell 4. Due to this electric field, the residual ions A and A' are pulled and accelerated to eventually collide with the exit lens electrode 44. These ions A and A' receive electrons from the exit lens electrode 44 and turn to neutral molecules, which adhere to the surface of the exit lens electrode 44.

When viewed as a whole, the ions A and A' remaining in the collision cell 4 are moving in the direction from the entrance lens electrode 42 to the exit lens electrode 44. Their moving speed rapidly increases due to the application of the aforementioned pulsed voltage. By this operation, almost all the residual ions A and A' will come in contact with the exit lens electrode 44 in a short period of time and be removed from the collision cell 4. When the objective ion B is subsequently introduced into the collision cell 4, the previous objective ion A and the product ions A' originating from the objective ion A scarcely remain. Thus, the crosstalk is prevented. As a result, it is possible to efficiently dissociate only the objective ion B and perform a mass analysis of the resultant product ions.

As a result of the previously described operation for removing the residual ions, the neutralized molecules deposit on the surface of the exit lens electrode 44. The voltage applied to the exit lens electrode 44 is basically a DC voltage, and the disturbance of the electric field due to the aforementioned contamination of the exit lens electrode 44 does not significantly affect the convergence and transport of the ions. Therefore, the ion passage efficiency will not seriously deteriorate even if the exit lens electrode 44 is somewhat contaminated. Furthermore, unlike the second-stage quadrupole 5, which is contained in the collision cell 4, a contaminated exit lens electrode 44 can be easily removed from the analysis chamber 1 so as to be dismantled and cleaned. The reassembling work is also easy since the required assembly accuracy is not as high as in the case of the quadrupole. Thus, the labor and time required for this cleaning work are significantly reduced as compared to the case of cleaning the quadrupole.

Second Embodiment

Figure 3:
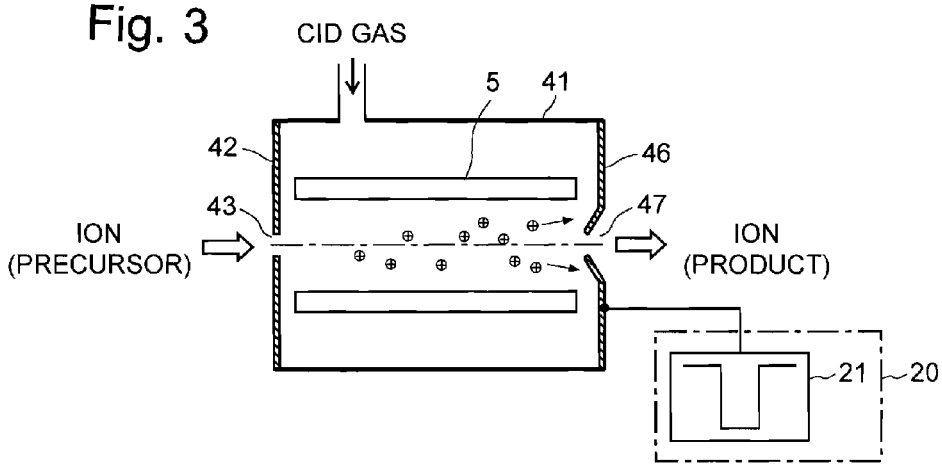
FIG. 3 is a configuration diagram of the collision cell and its power supply system in the MS/MS mass spectrometer of the second embodiment.

FIG. 3 is a schematic configuration diagram of the collision cell 4 and its power supply system in the MS/MS mass spectrometer of the second embodiment. In the MS/MS mass spectrometer of the second embodiment, the portion surrounding the aperture 47 of the exit lens electrode 46, to which a negative pulsed voltage is applied, is shaped like a skimmer protruding into the inner space of the collision cell 4. This structure strengthens the ion-pulling DC electric field created in the collision cell 4, so that the ions can be more easily accelerated. Particularly, even if the space surrounded by the second-stage quadrupole 5 is narrow, the effect of the DC electric field can spread over the entire space. This is effective in quickly removing the ions from the collision cell 4.

Third Embodiment

Figure 4:
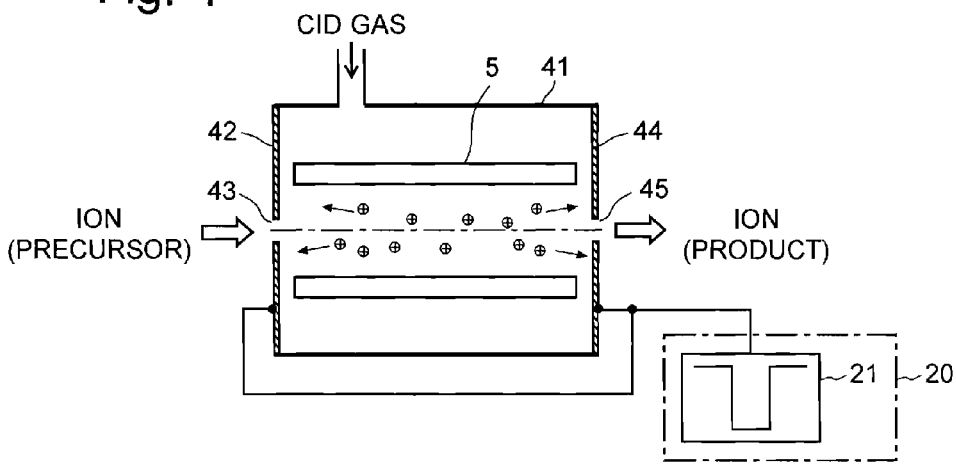
FIG. 4 is a configuration diagram of the collision cell and its power supply system in the MS/MS mass spectrometer of the third embodiment.

FIG. 4 is a schematic configuration diagram of the collision cell 4 and its power supply system in the MS/MS mass spectrometer of the third embodiment. In the MS/MS mass spectrometer of the third embodiment, the same pulsed voltage is applied to both the entrance lens electrode 42 and the exit lens electrode 44. Each of the residual ions within the collision cell 4 is pulled to either the entrance lens electrode 42 or the exit lens electrode 44 and normally to the closer one. Therefore, even an ion existing at positions close to the entrance lens electrode 42 in the collision cell 4 experiences an adequately strong force from the DC electric field. Furthermore, since the distances that the ions need to move to reach the lens electrodes 42 and 44 are short, the residual ions can be more quickly removed from the inner space of the collision cell 4.

Fourth Embodiment

Figure 5:
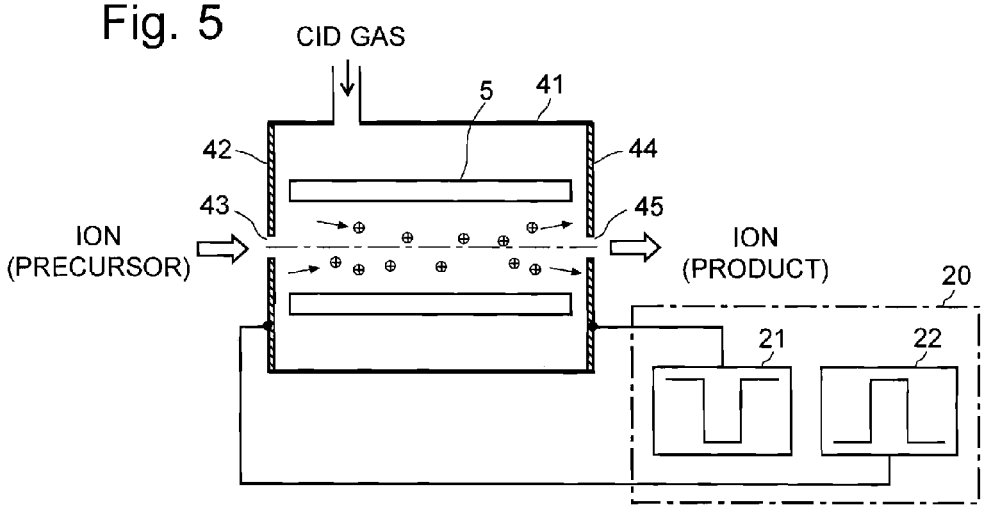
FIG. 5 is a configuration diagram of the collision cell and its power supply system in the MS/MS mass spectrometer of the fourth embodiment.

FIG. 5 is a schematic configuration diagram of the collision cell 4 and its power supply system in the MS/MS mass spectrometer of the fourth embodiment. In the MS/MS mass spectrometer of the fourth embodiment, the DC power source 20 includes, in addition to the first pulsed voltage source 21, a second pulsed voltage source 22 for generating a pulsed voltage having a polarity opposite to that of the pulsed voltage generated by the first pulsed voltage source 21. Similar to the first embodiment, the first pulsed voltage source 21 applies, to the exit lens electrode 44, a pulsed voltage having a polarity opposite to that of the ions within the collision cell 4, which is a negative pulsed voltage in the present case. On the other hand, the second pulsed voltage source 22 applies, to the entrance lens electrode 42, a pulsed voltage having a polarity opposite to that of the exit lens electrode 44, which is a positive pulsed voltage in the present case, at the same timing.

The polarity of the pulsed voltage applied to the entrance lens electrode 42 is the same as that of the ions remaining in the collision cell 4. Therefore, due to the effect of this DC electric field, the ions existing close to the entrance lens electrode 42 in the collision cell 4 are accelerated so as to be repelled from the entrance lens electrode 42 toward the exit lens electrode 44. Since both the entrance lens electrode 42 and the exit lens electrode 44 create a DC electric field that pulls the ions within the collision cell 4 toward the exit lens electrode 44, the ions move toward the exit lens electrode 44 and touch the same electrode 44. In this manner, the ions are quickly removed from the inner space of the collision cell 4.

In the first through fourth embodiments, when the pulse voltage is applied to one or both of the entrance lens electrode 42 and the exit lens electrode 44, it is preferable to continuously apply a predetermined radio-frequency voltage to the second-stage quadrupole 5 as in the preceding and succeeding periods. This operation makes the ions within the collision cell 4 converge around the ion optical axis (the central axis of the second-stage quadrupole 5), so that the ions are less likely to come in contact with the second-stage quadrupole 5. Furthermore, they can be efficiently guided to the lens electrodes 42 and 44 without being diffused in the inner space of the collision cell 4.

Fifth Embodiment

Figure 6:
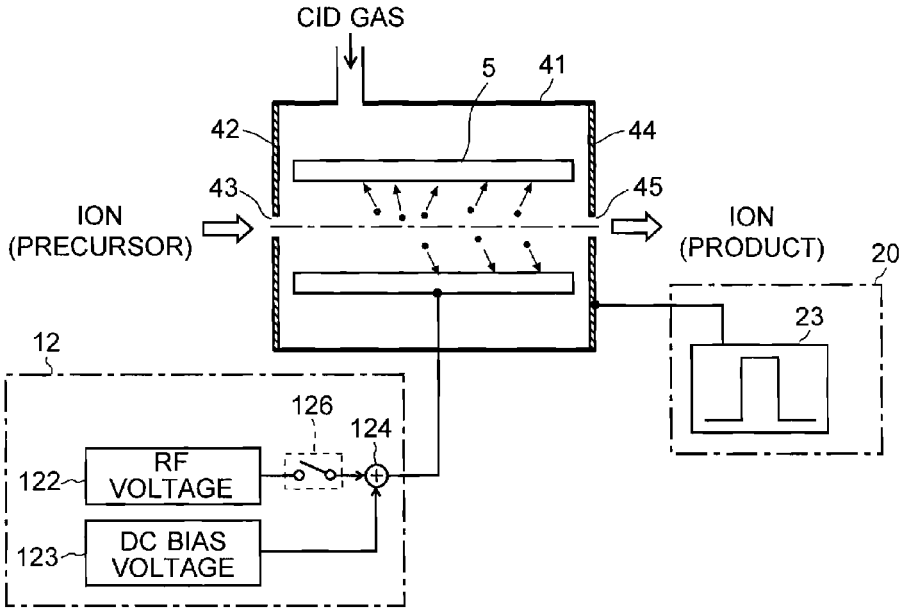
FIG. 6 is a configuration diagram of the collision cell and its power supply system in the MS/MS mass spectrometer of the fifth embodiment.

FIG. 6 is a schematic configuration diagram of the collision cell 4 and its power supply system in the MS/MS mass spectrometer of the fifth embodiment. Any of the MS/MS mass spectrometers of the first through fourth embodiments removes ions by bringing them into contact with one or both of the lens electrodes 42 and 44. By contrast, the MS/MS mass spectrometer of the fifth embodiment removes the ions by bringing them into contact with the second-stage quadrupole 5. To impel the ions remaining in the collision cell 4 toward the second-stage quadrupole 5, the DC power source 20 is provided with a pulsed voltage source 23 for generating a pulsed voltage having the same polarity as that of the ions. The pulsed voltage generated by this pulsed voltage source 23 has the same effect as that of the pulsed voltage generated by the second pulsed voltage 22 in the fourth embodiment. That is to say, when the pulsed voltage with the same polarity as that of the ions is applied to the exit lens electrode 44, the ions are repelled by the DC electric field created by that voltage.

Additionally, in the second power source 12, the generation of the radio-frequency voltage by the radio-frequency power source 122 is temporarily discontinued almost simultaneously with the application of the pulsed voltage. In the present example, a switch 126 is used to shut down the output from the radio-frequency voltage source 122. However, this is not the only method for discontinuing the radio-frequency voltage. In any case, at this point in time, only a DC bias voltage lower than the pulsed voltage is applied to the second-stage quadrupole 5. Since the ion-converging effect of the radio-frequency electric field no longer exists, the ions within the collision cell 4, most of which have been gathered around the ion optical axis, come to diffuse.

The DC electric field created in the previously described manner by the pulsed voltage applied to the lens electrode 44 repels the ions. In the space between the lens electrode 44 and the second-stage quadrupole 5, a DC potential gradient sloping from the lens electrode 44 down to the second-stage quadrupole 5 is created. Therefore, the ions that have been freed from the converging effect of the radio-frequency electric field move toward the second-stage quadrupole 5, to be eventually neutralized by touching the second-stage quadrupole 5. For the ions remaining in the collision cell 4, the distances that they must travel to reach the second-stage quadrupole 5 are, on the average, considerably shorter than the distances to reach the lens electrodes 42 and 44. Therefore, after the pulsed voltage is applied, the ions can reach the second-stage quadrupole 5 in a short period of time and be efficiently removed. The configuration of the present embodiment is superior to the first through fourth embodiments as far as the prevention of the crosstalk in the MS/MS analysis is concerned. However, a disadvantage exists in that troublesome cleaning work is required since the second-stage quadrupole 5 will be contaminated due to the adhesion of the ions.

Sixth Embodiment

Figure 7:
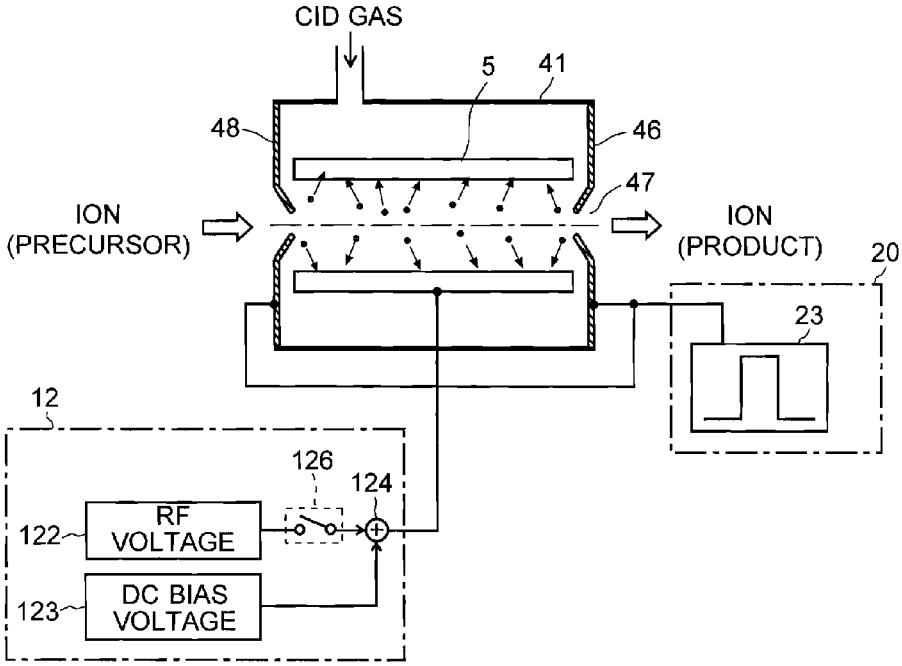
FIG. 7 is a configuration diagram of the collision cell and its power supply system in the MS/MS mass spectrometer of the sixth embodiment.

FIG. 7 is a schematic configuration diagram of the collision cell 4 and its power supply system in the MS/MS mass spectrometer of the sixth embodiment. The basic configuration and operation of the sixth embodiment are the same as those of the fifth embodiment. What differs from the fifth embodiment is that a pulsed voltage having the same polarity as that of the ion is applied to the entrance lens electrode 48 as well as the exit lens electrode 46, and that both the entrance lens electrode 48 and the exit lens electrode 46 are shaped like a skimmer similar to the exit lens electrode 46 in the second embodiment (refer to FIG. 3). The use of the skimmer-shaped lens electrodes 48 and 46 facilitates the creation of a strong DC electric field for repelling the ions within a region around the ion optical axis. As a result, the ions existing near the ion optical axis will be quickly impelled toward the second-stage quadrupole 5, to be removed by touching the second-stage quadrupole 5.

In the case of applying a pulsed voltage having the same polarity as that of the ions to only one of either the entrance lens electrode 42 (or 48) or the exit lens electrode 44 (or 46), it is preferable to apply the pulsed voltage to the exit lens electrode 44 (or 46) as in the fifth embodiment. This is based on the fact that the ions within the collision cell 4, when viewed as a whole, have a velocity component in the direction from the entrance lens electrode 42 to the exit lens electrode 44. If a component for repelling (pushing back) the ion by a DC electric field is added to an ion having the aforementioned velocity component, the ion moving toward the exit lens electrode 44 changes its moving direction by approximately 90 degrees to take the almost shortest path to the second-stage quadrupole 5.

As described thus far, the residual ions within the collision cell 4 can be removed by applying a pulsed signal to the lens electrodes 42 and 44 during the halt period in which the ion to be introduced into the collision cell 4 is changed. In this operation, it is desirable to appropriately control the timing of the application of the pulsed signal from the viewpoint that the contamination of the lens electrodes 42 and 44 or the second-stage quadrupole 5 due to the adhesion of the neutralized ions should be reduced to the lowest possible level. This point is hereinafter described.

Figure 8:
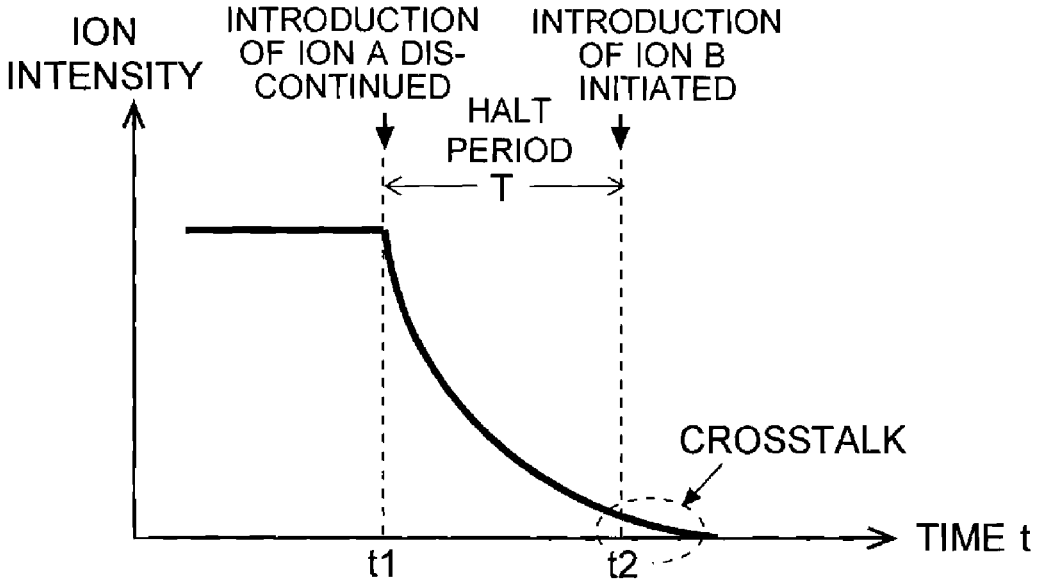
FIG. 8 is a graph showing a temporal change in the intensity of the residual ions within the collision cell in a conventional MS/MS mass spectrometer.

FIG. 8 is a diagram schematically showing a change in the intensity of the residual ions within the collision cell 4 before and after a change of the objective ion (precursor ion) in the first-stage quadrupole 3. The period of time T from the point (t1) where the introduction of the objective ion A into the collision cell 4 is discontinued to the point (t2) where the introduction of the next objective ion B is initiated is the halt period in which no ion is introduced into the collision cell 4.

Even after the introduction of the objective ion A into the collision cell 4 is discontinued, the objective ion A, which has just been introduced into the collision cell 4, and the product ions, which have originated from this objective ion A, still remain in the collision cell 4. These ions move toward the exit lens electrode 44, to be gradually discharged through the aperture 45. Therefore, as shown in FIG. 8, the intensity of the residual ions within the collision cell 4 decreases with time. However, since these ions are decelerated due to contact with the CID gas, some ions remain without being discharged even at the point t2 where the introduction of the next objective ion B is initiated. This is the aforementioned crosstalk. As is evident from FIG. 8, the crosstalk increases as the halt period T becomes shorter.

Figure 9:
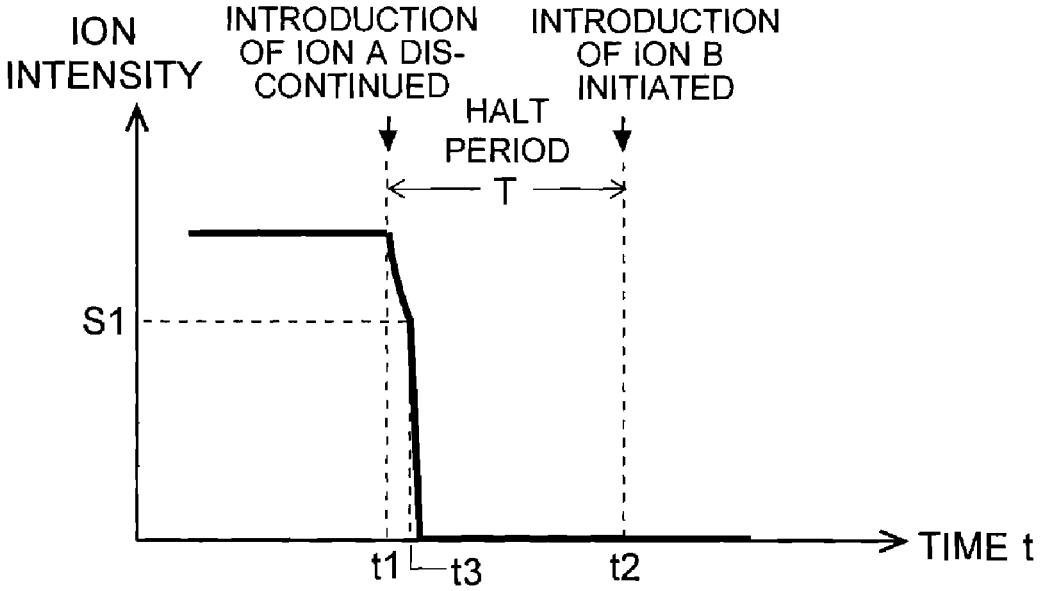
FIG. 9 is a graph showing one example of the temporal change in the intensity of the residual ions within the collision cell in the MS/MS mass spectrometer according to the present invention.

If a pulsed voltage for removing the residual ions is applied immediately after the point t1 where the introduction of the objective ion A is discontinued, or in the initial phase of the halt period T, then the residual ions will be quickly removed and the ion intensity will decrease as shown in FIG. 9. However, the amount of ions removed by this operation corresponds to the ion intensity S1 shown in FIG. 9, and most of these ions come in contact with the lens electrodes 42 and 44 (or the second-stage quadrupole 5 in the case of the fifth and sixth embodiments), so that the lens electrodes 42 and 44 will be significantly contaminated.

Figure 10:
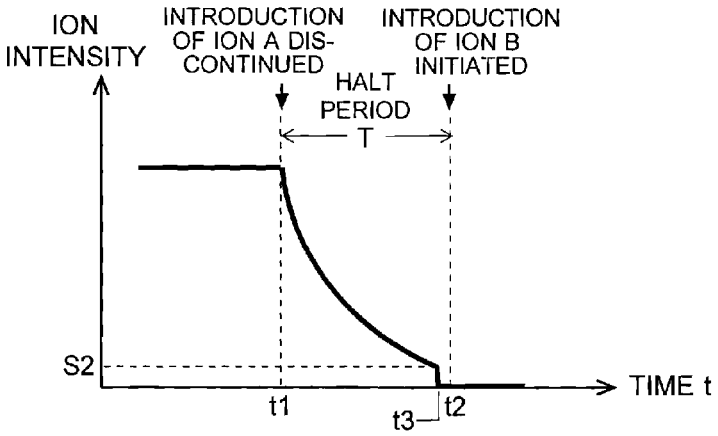
FIG. 10 is a graph showing another example of the temporal change in the intensity of the residual ions within the collision cell in the MS/MS mass spectrometer according to the present invention.
Figure 11:
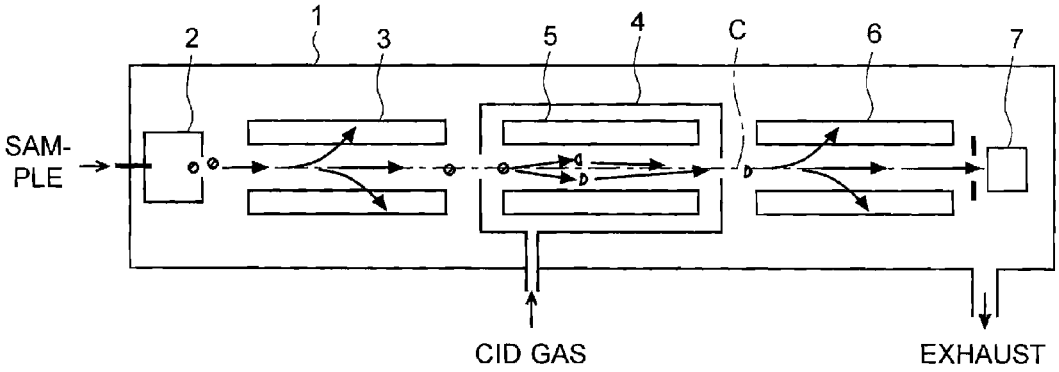
Fig. 11 PRIOR ART
FIG. 11 is an overall configuration diagram of a generally used MS/MS mass spectrometer.

By contrast, if the pulsed voltage is applied immediately before the point t2 where the introduction of the objective ion B is initiated, or immediately before the end of the halt period T, then the amount of ions removed by the effect of the voltage applied to the lens electrodes 42 and 44 corresponds to the ion intensity S2 shown in FIG. 10. This ion intensity S2 is lower than the ion intensity S1, which demonstrates that the amount of ions to be compulsorily removed is dramatically decreased. That is, by applying the pulsed voltage to the lens electrodes 42 and 44 at a timing as shown in FIG. 10, i.e. immediately before the end of the halt period T, the contamination of the lens electrodes 42 and 44 (or the second-stage quadrupole 5) can be reduced, so that the frequency of the cleaning work can be lowered. This holds true for any of the first through sixth embodiments.

Naturally, if the period of time from the application of the pulsed voltage to the lens electrodes 42 and 44 to the introduction of the objective ion B is too short, a crosstalk occurs since the introduction of the objective ion B takes place before the complete removal of the ions. To avoid this situation, an appropriate timing for applying the pulsed voltage should be found beforehand, for example, by an experimental measurement or computer simulation for determining the period of time required to remove the ions.

It should be noted that any of the previous embodiments is a mere example of the present invention. Any change, addition or modification appropriately made within the spirit of the present invention will be included within the scope of claims of this patent application.

The invention claimed is:

1. An MS/MS mass spectrometer comprising:

a first mass separator for selecting, as a precursor ion, an ion having a specific mass from among various kinds of ions;

a collision cell, containing an ion guide for transporting ions by a radio-frequency electric field while converging those ions, for making the precursor ion collide with a predetermined gas to dissociate the precursor ion by collision-induced dissociation;

a second mass separator for selecting an ion having a specific mass from among various kinds of product ions generated by the dissociation of the precursor ion, the first mass separator, the collision cell and the second mass separator being linearly arranged;

a) lens electrodes respectively provided at an entrance end and an exit end of the collision cell;

b) a voltage-applying means for applying a DC voltage to one or both of the entrance lens electrode and the exit lens electrode; and c) a control means for controlling the voltage-applying means so that, when an ejection of ions into the first mass separator is halted, a pulsed DC voltage for either pulling or repelling the ions within the collision cell is applied to the aforementioned one or both of the lens electrodes in order to remove the ions from the collision cell.

2. The MS/MS mass spectrometer according to claim 1, which is characterized in that the voltage-applying means apply, to the exit lens electrode, a DC voltage with a polarity opposite to that of the ions within the collision cell.

3. The MS/MS mass spectrometer according to claim 1, which is characterized in that the voltage-applying means applies, to both the entrance lens electrode and the exit lens electrode, a DC voltage with a polarity opposite to that of the ions within the collision cell.

4. The MS/MS mass spectrometer according to claim 1, which is characterized in that the voltage-applying means applies DC voltages with opposite polarities to the entrance lens electrode and the exit lens electrode, respectively.

5. The MS/MS mass spectrometer according to claim 4, which is characterized in that the DC voltage applied to the exit lens electrode has a polarity opposite to that of the ions within the collision cell.

6. The MS/MS mass spectrometer according to claim 1, which is characterized in that:

the voltage-applying means applies a DC voltage having a same polarity as that of the ions within the collision cell to one or both of the entrance lens electrode and the exit lens electrode; and the control means operates the voltage-applying means to discontinue an application of the radio-frequency voltage to the ion guide at a timing of applying the pulsed DC voltage to one or both of the entrance lens electrode and the exit lens electrode in order to remove the ions from the collision cell.

7. The MS/MS mass spectrometer according to claim 1, which is characterized in that the predetermined timing is set at a point in time immediately before an end of a halt period when an ejection of ions into the first mass separator is temporarily halted to change a target ion to be selected in the first mass separator.

8. An MS/MS mass spectrometer comprising:

a first mass separator for selecting, as a precursor ion, an ion having a specific mass from among various kinds of ions;

a collision cell, containing an ion guide for transporting ions by a radio-frequency electric field while converging those ions, for making the precursor ion collide with a predetermined gas to dissociate the precursor ion by collision-induced dissociation; and a second mass separator for selecting an ion having a specific mass from among various kinds of product ions generated by the dissociation of the precursor ion, the first mass separator, the collision cell and the second mass separator being linearly arranged;

a) lens electrodes respectively provided at an entrance end and an exit end of the collision cell;

b) at least one power source for applying a DC voltage to one or both of the entrance lens electrode and the exit lens electrode; and c) a controller for controlling the at least one power source so that, when an ejection of ions into the first mass separator is halted, a pulsed DC voltage for either pulling or repelling the ions within the collision cell is applied to the aforementioned one or both of the lens electrodes in order to remove the ions from the collision cell.

9. The MS/MS mass spectrometer according to claim 8, which is characterized in that the at least one power source applies, to the exit lens electrode, a DC voltage with a polarity opposite to that of the ions within the collision cell.

10. The MS/MS mass spectrometer according to claim 8, which is characterized in that the at least one power source applies, to both the entrance lens electrode and the exit lens electrode, a DC voltage with a polarity opposite to that of the ions within the collision cell.

11. The MS/MS mass spectrometer according to claim 8, which is characterized in that the at least one power source applies DC voltages with opposite polarities to the entrance lens electrode and the exit lens electrode, respectively.

12. The MS/MS mass spectrometer according to claim 11, which is characterized in that the DC voltage applied to the exit lens electrode has a polarity opposite to that of the ions within the collision cell.

13. The MS/MS mass spectrometer according to claim 8, which is characterized in that:

the at least one power source applies a DC voltage having a same polarity as that of the ions within the collision cell to one or both of the entrance lens electrode and the exit lens electrode; and the control operates the at least one power source to discontinue an application of the radio-frequency voltage to the ion guide at a timing of applying the pulsed DC voltage to one or both of the entrance lens electrode and the exit lens electrode in order to remove the ions from the collision cell.

14. The MS/MS mass spectrometer according to claim 8, which is characterized in that the predetermined timing is set at a point in time immediately before an end of a halt period when an ejection of ions into the first mass separator is temporarily halted to change a target ion to be selected in the first mass separator.

* * * * *